US009004671B2

(12) United States Patent
Sakano

(10) Patent No.: US 9,004,671 B2
(45) Date of Patent: Apr. 14, 2015

(54) IMAGE FORMING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 106 days.

(21) Appl. No.: 13/248,916

(22) Filed: Sep. 29, 2011

(65) Prior Publication Data

US 2012/0133718 A1 May 31, 2012

(30) Foreign Application Priority Data

Nov. 30, 2010 (JP) ..... 2010-266912

(51) Int. Cl.

| | |
|---|---|
| ***B41J 2/01*** | (2006.01) |
| ***B41J 2/015*** | (2006.01) |
| ***B41J 3/54*** | (2006.01) |
| ***B41J 2/21*** | (2006.01) |
| ***B41J 11/00*** | (2006.01) |
| ***B41J 13/00*** | (2006.01) |

(52) U.S. Cl.

CPC ..... *B41J 3/546* (2013.01); *B41J 2/2114* (2013.01); *B41J 11/0015* (2013.01); *B41J 11/006* (2013.01); *B41J 13/0009* (2013.01)

(58) Field of Classification Search

USPC ..... 347/104, 101, 21

See application file for complete search history.

(56) References Cited

U.S. PATENT DOCUMENTS

| | | | | |
|---|---|---|---|---|
| 6,012,809 | A | 1/2000 | Ikeda et al. | |
| 6,502,934 | B2 * | 1/2003 | Yamamoto et al. | 347/104 |
| 7,451,981 | B2 * | 11/2008 | Taguchi et al. | 271/226 |
| 7,607,749 | B2 * | 10/2009 | Tabata et al. | 347/14 |
| 7,832,822 | B2 * | 11/2010 | Kiyama et al. | 347/14 |
| 8,277,041 | B2 * | 10/2012 | Yamamoto | 347/14 |
| 8,322,808 | B2 * | 12/2012 | Sugahara | 347/9 |
| 8,454,151 | B2 * | 6/2013 | Kanome et al. | 347/102 |
| 2005/0073085 | A1 | 4/2005 | Fukada et al. | |

(Continued)

FOREIGN PATENT DOCUMENTS

| | | |
|---|---|---|
| CN | 1640799 A | 7/2005 |
| CN | 1654209 A | 8/2005 |

(Continued)

OTHER PUBLICATIONS

European Patent Office, extended European Search Report for European Patent Application No. 11182975.0, dated Mar. 28, 2012.

(Continued)

*Primary Examiner* — Julian Huffman
*Assistant Examiner* — Leonard S Liang
(74) *Attorney, Agent, or Firm* — Baker Botts L.L.P.

(57) ABSTRACT

An image forming apparatus comprises a conveyor to convey a recording medium in a conveyance direction; first and second applicators to respectively apply first and second liquids to the recording medium, the second applicator being disposed downstream of the first applicator. One of the first and second liquids causes coagulation or precipitation of a component of the other liquid. The conveyor comprises a first pair of rollers; a second pair of rollers; and at least one third pair of rollers. The second applicator is disposed between the first and second pair of rollers. The first pair of rollers and the at least one third pair of rollers constitute a plurality of upstream-side pairs of rollers disposed upstream of the second pair of rollers, and a distance between adjacent two of the upstream-side pairs of rollers is larger than a distance between the first and second pair of rollers.

11 Claims, 4 Drawing Sheets

(56) References Cited

U.S. PATENT DOCUMENTS

| | | | | |
|---|---|---|---|---|
| 2007/0064032 | A1* | 3/2007 | Kawabata | 347/9 |
| 2008/0297573 | A1 | 12/2008 | Iwasaki et al. | |
| 2010/0002037 | A1* | 1/2010 | Kusuhata | 347/16 |
| 2010/0039461 | A1 | 2/2010 | Kusunoki | |
| 2010/0220160 | A1 | 9/2010 | Shimizu et al. | |
| 2011/0242152 | A1* | 10/2011 | Takeda et al. | 347/1 |
| 2012/0001992 | A1* | 1/2012 | Yamamoto et al. | 347/104 |
| 2012/0050431 | A1* | 3/2012 | Onishi et al. | 347/101 |
| 2012/0062644 | A1* | 3/2012 | Hara et al. | 347/20 |
| 2012/0081486 | A1* | 4/2012 | Sakano | 347/104 |
| 2012/0218347 | A1* | 8/2012 | Itogawa | 347/34 |

FOREIGN PATENT DOCUMENTS

| | | | |
|---|---|---|---|
| JP | H09-254376 | A | 9/1997 |
| JP | 2002-059598 | A | 2/2002 |
| JP | 2002-096453 | A | 4/2002 |
| JP | 2002-137378 | A | 5/2002 |
| JP | 2004-106359 | A | 4/2004 |
| JP | 2006-027159 | A | 2/2006 |
| JP | 2009-248348 | A | 10/2009 |
| JP | 2009248348 | A * | 10/2009 |
| JP | 2010-042614 | A | 2/2010 |
| JP | 2010-194526 | A | 9/2010 |

OTHER PUBLICATIONS

Japan Patent Office, Notification of Reasons for Refusal for Japanese Patent Application No. 2010-266912, mailed Dec. 17, 2013.

State Intellectual Property Office of the People's Republic of China, Notification of First Office Action for Chinese Patent Application No. 201110305675.3, mailed Dec. 2, 2013.

State Intellectual Property Office of the People's Republic of China, Notification of the Second Office Action for counterpart Chinese Patent Application No. 201110305675.3, mailed Aug. 13, 2014.

* cited by examiner

IMAGE FORMING APPARATUS

CROSS REFERENCE TO RELATED APPLICATION

The present application claims priority from Japanese Patent Application No. 2010-266912, which was filed on Nov. 30, 2010, the disclosure of which is herein incorporated by reference in its entirety.

BACKGROUND OF THE INVENTION

1. Field of the Invention

The present invention relates to an image forming apparatus configured to form an image on a recording medium by applying liquids thereto.

2. Discussion of Related Art

There is known an ink-jet recording apparatus including: a treatment-liquid coating portion, as a first applicator, configured to coat a recording medium supplied from a sheet supply portion with a treatment liquid; a head (an ink ejecting portion), as a second applicator, configured to eject ink to the recording medium which has been coated with the treatment liquid; and two roller pairs disposed so as to sandwich the head therebetween in a conveyance direction of the recording medium.

SUMMARY OF THE INVENTION

In the ink-jet recording apparatus described above, however, where a recording medium whose size or length in the conveyance direction is smaller than a certain length (corresponding to a distance between the two roller pairs) is conveyed between the two roller pairs, the recording medium stops at a position at which the recording medium is opposed to the head without being conveyed. In this instance, because the recording medium has been coated with the treatment liquid by the treatment-liquid coating portion, the recording medium gradually curves and comes into contact with an ejection surface of the head, so that the treatment liquid coated on the recording medium attaches to the ejection surface of the head. Where the treatment liquid attaches to the ejection surface, the treatment liquid reacts with ink in nozzles of the ejection surface, causing coagulation. As a result, solid matters are formed by the reaction in the nozzles and in the vicinity thereof. Accordingly, the head suffers from an ejection failure of the ink from the nozzles.

It is therefore an object of the present invention to provide an image forming apparatus having a first applicator configured to apply a first liquid to a recording medium and a second applicator configured to apply a second liquid to the recording medium, wherein the first liquid applied to the recording medium is restrained from being attached to the second applicator.

The above-indicated object of the invention may be achieved according to a principle of the invention, which provides an image forming apparatus, comprising: a conveyor configured to convey a recording medium through a conveyance path in a conveyance direction; a first applicator configured to apply a first liquid to the recording medium that is conveyed by the conveyor; and a second applicator disposed downstream of the first applicator in the conveyance direction and configured to apply a second liquid to the recording medium that is conveyed by the conveyor, wherein one of the first liquid and the second liquid acts on the other of the first liquid and the second liquid, causing one of coagulation and precipitation of a component of the other of the first liquid and the second liquid, wherein the conveyor includes: a first conveying portion configured to convey the recording medium in the conveyance direction while holding the recording medium; a second conveying portion disposed downstream of the first conveying portion in the conveyance direction and configured to convey the recording medium in the conveyance direction while holding the recording medium; and at least one third conveying portion disposed upstream of the first conveying portion in the conveyance direction and each configured to convey the recording medium in the conveyance direction while holding the recording medium, wherein the second applicator is disposed between the first conveying portion and the second conveying portion, and wherein the second conveying portion and the at least one third conveying portion constitute a plurality of upstream-side conveying portions disposed upstream of the second conveying portion, and a distance by which adjacent two of the plurality of upstream-side conveying portions are spaced apart from each other in the conveyance direction is larger than a distance by which the first conveying portion and the second conveying portion are spaced apart from each other in the conveyance direction.

Where the at least one third conveying portion includes a plurality of third conveying portions, the number of the upstream-side conveying portions is at least three in total. In this instance, at least one of distances between adjacent two of the at least three upstream-side conveying portions is larger than the distance between the first conveying portion and the second conveying portion.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be explained preferred embodiments of the present invention with reference to the drawings.

Figure 1:
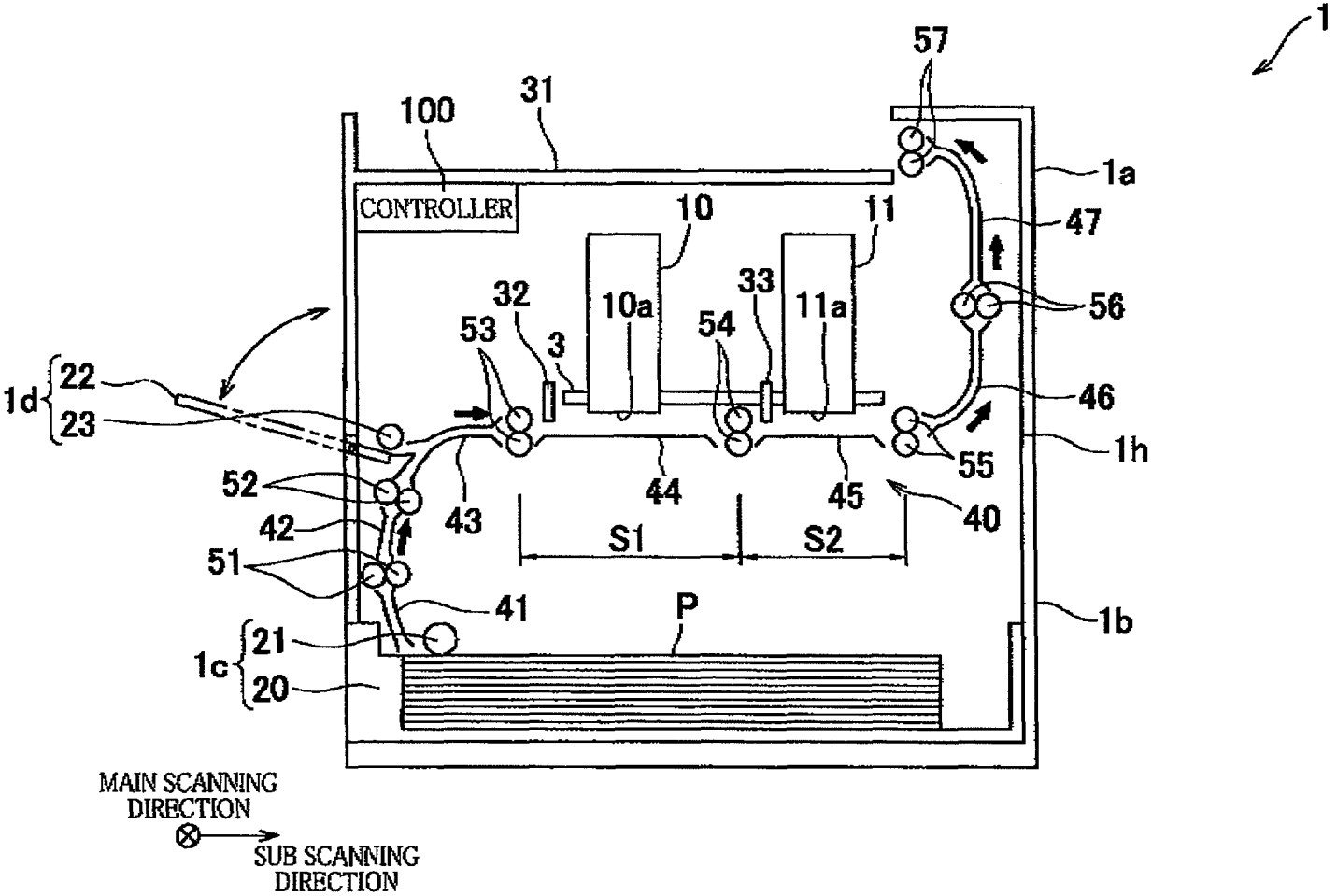
FIG. 1 is a schematic side view showing an overall structure of an ink-jet printer as an image forming apparatus according to a first embodiment of the invention.

Referring first to FIG. 1, there will be explained an overall structure of an ink-jet printer 1 as an image forming apparatus according to a first embodiment of the present invention.

The printer 1 includes a first housing 1*a* and a second housing 1*b* each of which has a rectangular parallelepiped shape and which have substantially the same size. The first housing 1*a* is open in its lower surface while the second housing 1*b* is open in its upper surface. The first housing 1*a* is superimposed on the second housing 1*b*, so that the openings of the respective first and second housings 1*a*, 1*b* are closed, defining a space inside the printer 1. A discharge portion 31 is provided on a top plate of the first housing 1*a*. In the space defined by the first and second housings 1*a*, 1*b*, there is formed a sheet conveyance path through which a sheet P as a recording medium is conveyed from a first sheet supply portion 1*c* or a second sheet supply portion 1*d*, each as a sheet supplier, to the discharge portion 31, along a conveyance direction (indicated by black bold arrows in FIG. 1). Hereinafter, each of the first sheet supply portion 1*c* and the second sheet supply portion 1*d* is simply referred to as the "sheet supply portion" where it is not necessary to distinguish the two sheet supply portions 1*c*, 1*d* from each other.

The first housing 1*a* accommodates two heads 10, 11, two cartridges (not shown) for the respective heads 10, 11, a controller 100 for controlling operations of various functional portions of the printer 1, etc. The first housing 1*a* further accommodates a part of a conveyor mechanism 40 configured to convey the sheet P from the first sheet supply portion 1*c* or the second sheet supply portion 1*d* to the discharge portion 31. The second housing 1*b* accommodates the first sheet supply portion 1*c*, a sheet supply roller 23 of the second sheet supply portion 1*d*, a part of the conveyor mechanism 40, etc.

As shown in FIG. 1, the first housing 1*a* is pivotable, with respect to the second housing 1*b*, about a hinge portion 1*h* provided at one side of a lower end of the first housing 1*a*. By pivoting the first housing 1*a* about the hinge portion 1*h*, the first housing 1*a* is placed selectively between: a closed position shown in FIG. 1 at which the respective openings of the first and second housings 1*a*, 1*b* are closed, in other words, at which the first housing 1*a* and the second housing 1*b* are in contact with each other; and an open position at which the first housing 1*a* is located away from the second housing 1*b*. The open position in the present embodiment is a position at which the first housing 1*a* is pivoted about the hinge portion 1*h* as a pivot point, such that the first housing 1*a* is opened at an inclination angle of about 35° relative to the horizontal plane, for instance. When the first housing 1*a* is placed at the open position, the sheet conveyance path is exposed to an exterior, ensuring, on the sheet conveyance path, a working space for a user. The thus ensured working space enables the user to remove a sheet dropped to a position (i.e., on a guide 44 as described later) where the sheet is opposed to the head 10.

The cartridges respectively store an image-quality enhancement liquid and a black ink to be supplied to the corresponding heads 10, 11. In the present embodiment, the image-quality enhancement liquid (as a first liquid) is supplied to the head 10 from one of the cartridges while the black ink (as a second liquid) is supplied to the head 11 from the other of the cartridges. The image-quality enhancement liquid has a function of preventing ink spreading and ink strikethrough, a function of improving color development properties of ink and quick-drying properties of ink, etc. In general, there is used, for pigment ink, an image-quality enhancement liquid which coagulates a pigment coloring matter, and there is used, for dye ink, an image-quality enhancement liquid which precipitates a dye coloring matter. As the material of the image-quality enhancement liquid, there is suitably used a liquid containing a cationic high polymer or a liquid containing a polyvalent metallic salt such as a magnesium salt. When ink is attached to a region of the sheet P on which the image-quality enhancement liquid has been applied, the polyvalent metallic salt or the like in the image-quality enhancement liquid acts on a dye or a pigment as a colorant of the ink, so as to cause coagulation or precipitation of an insoluble or sparingly soluble metal complex or the like. The liquids in the respective cartridges (i.e., the ink and the image-quality enhancement liquid) are automatically sucked therefrom into the corresponding heads 10, 11 owing to negative pressures on the sides of the heads 10, 11.

Each of the two heads 10, 11 is of a line type and has a longer dimension in a main scanning direction. Each head 10, 11 has a generally rectangular parallelepiped contour. These heads 10, 11 are spaced apart from each other in a sub scanning direction and are supported by the first housing 1*a* via a frame 3. The head 10 is disposed upstream of the head 11 in the conveyance direction. In other words, the head 11 is disposed downstream of the head 10. On an upper surface of each of the heads 10, 11, a joint (not shown) to which a flexible tube (not shown) is connected is provided. A multiplicity of ejection openings are open in a lower surface of each of the heads 10, 11 so that the lower surface functions as an ejection surface 10*a*, 11*a*. In each of the heads 10, 11, there are formed flow channels through which the liquid supplied from the corresponding cartridge via the corresponding tube and joint flows to the ejection openings.

The first sheet supply portion 1*c* includes a sheet tray 20 and a sheet supply roller 21. The sheet tray 20 is attachable to and detachable from the first housing 1*a* in the sub scanning direction. The sheet tray 20 is a box which is open upward and is capable of accommodating a stack of the sheets P. The sheet supply roller 21 is configured to rotate under the control of the controller 100 and to supply an uppermost one of the sheets P in the sheet tray 20.

The second sheet supply portion 1*d* includes a manual feeding tray 22 and the sheet supply roller 23. The second sheet supply portion 1*d* is configured such that a sheet can be supplied therefrom to a portion of the sheet conveyance path, which portion is intermediate between the first sheet supply portion 1*c* and the head 10. The manual feeding tray 22 is a plate-like member pivotably supported by the second housing 1*b*. Normally, in other words, when the second sheet supply portion 1*d* is not used, the manual feeding tray 22 is accommodated in an opening which is formed in side walls of the first and second housings 1*a*, 1*b*. The opening has a size large enough to accommodate the manual feeding tray 22. That is, the manual feeding tray 22 constitutes a part of the side walls of the first and second housings 1*a*, 1*b* when accommodated in the opening. By pivoting and opening the manual feeding tray 22 as shown in FIG. 1, the second sheet supply portion 1*d* can be used. After the manual feeding tray 22 is thus opened, the sheets P having a suitable size are placed thereon and the sheet supply roller 23 is driven under the control of the controller 100, whereby an uppermost one of the sheets P on the manual feeding tray 22 is supplied to the sheet conveyance path.

The conveyor mechanism 40 includes seven guides 41-47 and seven feed roller pairs 51-57. The conveyor mechanism 40 is configured to convey the sheet P such that the sheet P supplied from the first sheet supply portion 1*c* or the second sheet supply portion 1*d* passes positions at which the sheet P is opposed to the respective two heads 10, 11 (hereinafter the positions are referred to as "head-sheet opposed positions" where appropriate) and thereafter the sheet P is conveyed to the discharge portion 31. The conveyor mechanism 40 defines the sheet conveyance path. Each of the feed roller pairs 51-57 has two rollers disposed so as to be opposed to each other for nipping the sheet P therebetween. At least one of the two rollers of each roller pair is driven by the controller 100, whereby the sheet P is conveyed in the conveyance direction while being nipped by the two rollers of each roller pair.

The guides 41-43 are configured to guide the sheet P supplied from the first sheet supply portion 1*c* to the head 10. In the guide 43, there is formed a joint portion at which a portion of the sheet conveyance path through which the sheet P supplied from the second sheet supply portion 1*d* is conveyed and a portion of the sheet conveyance path through which the sheet P supplied from the first sheet supply portion 1*c* is conveyed are joined. The sheet P supplied from the second sheet supply portion 1*d* is guided by the guide 43 to the head 10. The feed roller pair 51 is disposed between the two guides 41, 42 and conveys the sheet P supplied from the first sheet supply portion 1*c* to the feed roller pair 52. The feed roller pair 52 is disposed between the two guides 42, 43 and conveys the sheet P sent from the feed roller pair 51 to the feed roller pair 53. The feed roller pair 53 (as a third conveying portion) is disposed between the two guides 43, 44 and conveys the sheet P sent from the feed roller pair 52 or the second sheet supply portion 1*d* to the feed roller pair 54.

The guide 44 is disposed at a position where the guide 44 is opposed to the ejection surface 10*a* of the head 10 and is configured to support the sheet P conveyed by the feed roller pair 53, from the underside of the sheet P. The guide 45 is disposed at a position where the guide 46 is opposed to the ejection surface 11*a* of the head 11 and is configured to support the sheet P sent by the feed roller pair 54, from the underside of the sheet P. The guides 46, 47 are configured to guide the sheet P that has passed the respective head-sheet opposed positions described above, to the discharge portion 31.

The feed roller pair 54 (as a first conveying portion) is disposed between the two guides 44, 45 and between the heads 10, 11 in the sub scanning direction. The feed roller pair 54 is configured to convey the sheet P sent by the feed roller pair 53 to the feed roller pair 55. The feed roller pair 54 is disposed at a position where the head 10 is interposed between the feed roller pair 54 and the feed roller pair 53 in the conveyance direction (the sub scanning direction). The feed roller pair 56 (as a second conveying portion) is disposed between the guides 45, 46 and is disposed at a position where the head 11 is interposed between the feed roller pair 55 and the feed roller pair 54 in the conveyance direction (the sub scanning direction). The feed roller pair 55 is configured to convey the sheet P sent by the feed roller pair 54 to the feed roller pair 56.

The feed roller pair 53 is spaced apart from the feed roller pair 54 in the conveyance direction, such that a distance S1 between the feed roller pair 53 and the feed roller pair 54 is larger than a distance S2 between the feed roller pair 54 and the feed roller pair 55. Further, the three feed roller pairs 51-58 are disposed such that a distance between the first sheet supply portion 1*c* and the feed roller pair 51, a distance between the feed roller pair 51 and the feed roller pair 52, a distance between the feed roller pair 52 and the feed roller pair 53, and a distance between the second sheet supply portion 1*d* and the feed roller pair 58 are smaller than the distance S2. In a curved portion of the sheet conveyance path that extends from the first sheet supply portion 1*c* to the feed roller pair 53, the distance between any of the adjacent two components in the conveyance direction is made small, whereby it is possible to restrain a jam of the sheet P which would be otherwise caused by contact of the sheet P with the guides due to the toughness of the sheet P.

The feed roller pair 56 is disposed between the guides 46, 47 and is configured to convey the sheet P sent by the feed roller pair 55 to the feed roller pair 57. The feed roller pair 57 is disposed between the guide 47 and the discharge portion 31 and is configured to convey the sheet P sent by the feed roller pair 56 to the discharge portion 31.

In the conveyor mechanism 40, the upper portion of the guide 43, the upper rollers of the respective feed roller pairs 53-55, the two feed roller pairs 56, 57, and the two guides 46, 47 are supported by the first housing 1*a*. The rest of the conveyor mechanism 40 is supported by the second housing 1*b*. In this structure, when the first housing 1*a* is placed at the open position, a part of the sheet conveyance path that is opposed to the heads 10, 11 are exposed to the exterior, ensuring the user of the working space. Accordingly, it is possible to remove the sheet dropped downward onto the guide 44 at the position where the sheet is opposed to the head 10, without being nipped by and between the feed roller pairs 53, 54.

In the thus constructed conveyor mechanism 40, when the sheet P is supplied from the first or second sheet supply portion 1*c*, 1*d* to the respective head-sheet opposed positions at which the sheet P is opposed to the respective heads 10, 11, the heads 10, 11 are driven under the control of the controller 100. That is, the image-quality enhancement liquid is ejected from the ejection openings of the ejection surface 10*a* to the surface of the sheet P, and subsequently the ink is ejected from the ejection openings of the ejection surface 11*a* to a region of the surface of the sheet P to which the image-quality enhancement liquid has been attached. Thus, an image is formed on the sheet P. The ink ejection operation from the ejection openings is carried out under the control of the controller 100 on the basis of detection signals outputted from respective sensors 32, 33. Thereafter, the sheet P is discharged to the discharge portion 31 by the conveyor mechanism 40.

The two sensors 32, 33 connected to the controller 100 are provided in the first housing 1*a*. The sensor 32 is disposed between the feed roller pair 53 and the head 10 and is configured to detect the sheet P and output the detection signal to the controller 100. The sensor 33 is disposed between the feed roller pair 54 and the head 11 and is configured to detect the sheet P and output the detection signal to the controller 100.

Figure 2:
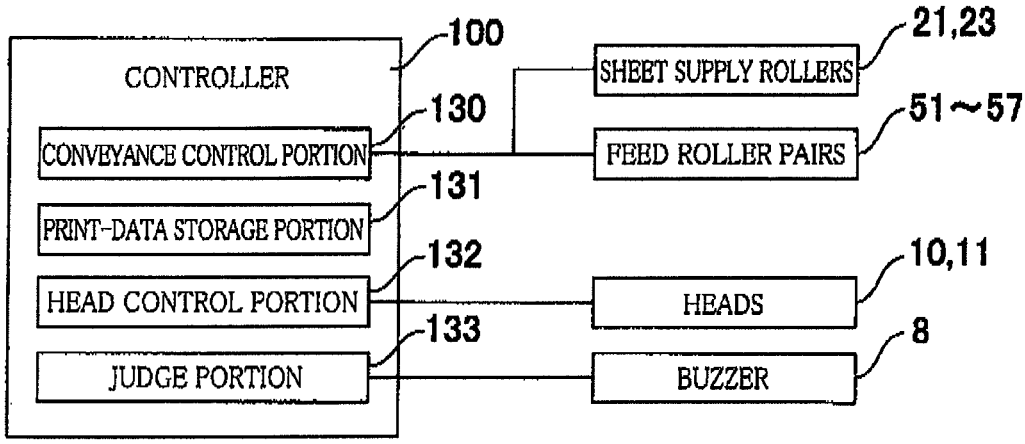
FIG. 2 is a block diagram showing an electric structure of the printer.
Figure 3:
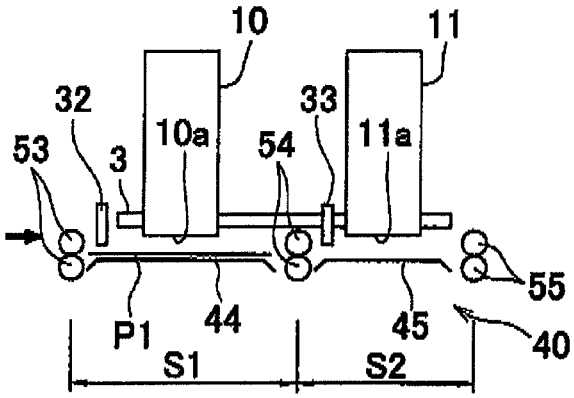
FIG. 3 is a view showing a state in which a sheet whose size is smaller than a certain size is conveyed in a printing operation of the printer.

Referring next to FIG. 2, the controller 100 will be explained. The controller 100 includes a Central Processing Unit (CPU), an Electrically Erasable and Programmable Read Only Memory (EEPROM) configured to store programs to be executed by the CPU and to rewritably store data to be utilized in the programs, and a Random Access Memory (RAM) configured to temporarily store data when the programs are executed. The control programs are stored in various recording media such as a flexible disk, a CD-ROM, and a memory card. The control programs are installed on the EEPROM from those recording media. Execution of the control programs by the CPU achieves various functional portions shown in FIG. 2 that constitute the controller 100. The controller 100 transmits and receives data to and from an external device such as a personal computer (PC) connected to the printer 1, via an I/F.

The controller 100 is for controlling the printer 1 as a whole and includes a conveyance control portion 130, a print-data storage portion 131, a head control portion 132, and a judge portion 133, as shown in FIG. 2.

The conveyance control portion 130 is configured to control the sheet supply rollers 21, 23 and the seven feed roller pairs 51-57 on the basis of conveyance data contained in print data that is stored in the print-data storage portion 131, such that the sheet P is conveyed in the conveyance direction. The conveyance control portion 130 and the conveyor mechanism 40 constitute a conveyor.

The print-data storage portion 131 stores the print data which contains: image data transmitted from the external device and relating to an image to be printed on the sheet P; and the conveyance data. The image data includes ejection data of the image-quality enhancement liquid from the head 10 and ejection data of the ink form the head 11. In the present embodiment, the ejection data indicates an amount of the ink or the image-quality enhancement liquid to be ejected from each ejection opening in every printing period, i.e., zero, a small amount, a medium amount, or a large amount. The ejection data of the image-quality enhancement liquid is determined on the basis of the image data. More specifically, the ejection data of the image-quality enhancement liquid is determined such that the image-quality enhancement liquid is attached to dot regions to which the ink ejected from the head 11 on the basis of the image data is to be attached. That is, the image-quality enhancement liquid is ejected to a region of the sheet P on which the image is to be formed and is not ejected to a region of the sheet P on which the image is not to be formed.

The head control portion 132 is configured to control the heads 10, 11 on the basis of the ejection data stored in the print-data storage portion 131, such that desired volumes of the image-quality enhancement liquid and the ink are ejected to the sheet P from the respective heads 10, 11. En this instance, the head control portion 132 controls the head 10 to start ejecting the image-quality enhancement liquid to the sheet P after a lapse of a prescribed time from detection of the sheet P by the sensor 32. Here, the prescribed time is obtained by dividing a distance along the conveyance path between the sheet at a time when the sensor 32 detects the sheet and the most upstream ejection openings of the head 10, by a conveyance speed of the sheet P. Further, the head control portion 132 controls the head 11 to start ejecting the ink to the sheet P after a lapse of a prescribed time from detection of the sheet P by the sensor 33. Similarly, the prescribed time is obtained by dividing a distance along the conveyance path between the sheet at a time when the sensor 33 detects the sheet and the most upstream ejection openings of the head 11, by the conveyance speed of the sheet P. The head 10 constitutes a first applicator while the head 11 constitutes a second applicator.

The judge portion 133 is configured to judge that a conveyance failure of the sheet P is occurring in an instance where a detection time interval between detection of the sheet P by the sensor 32 and detection of the sheet P by the sensor 33 exceeds a prescribed time. Here, the prescribed time is obtained by dividing a spacing distance between the two sensors 32, 33 along the conveyance direction by the conveyance speed of the sheet P. Further, the judge portion 133 is configured to control a buzzer 8 to generate a sound where the judgment of occurrence of the sheet conveyance failure is made as described above. This arrangement makes it possible to notify the user of the occurrence of the conveyance failure of the sheet P in a portion of the sheet conveyance path opposed to the head 10.

Next, a printing operation of the printer 1 will be explained. When the controller 100 receives the print data transmitted from the external device, the conveyance control portion 130 controls the sheet supply roller 21 to supply the sheet P from the sheet tray 20 or controls the sheet supply roller 23 to supply the sheet P from the manual feeding tray 22. In this instance, where the sheet P is supplied from the sheet tray 20, the conveyance control portion 130 controls the seven feed roller pairs 51-57 so as to drive the same 51-57. On the other hand, where the sheet P is supplied from the manual feeding tray 22, the conveyance control portion 130 controls the five feed roller pairs 53-57 so as to drive the same 53-57. Thus, the sheet P supplied from the sheet tray 20 or the manual feeding tray 22 is conveyed to the head-sheet opposed positions at which the sheet P is opposed to the respective heads 10, 11.

Subsequently, the head control portion 132 controls the head 10 to eject the image-quality enhancement liquid to the sheet P after a lapse of the prescribed time from detection of the sheet P by the sensor 32. Thus, a transparent image by the image-quality enhancement liquid that corresponding to the image to be formed is formed at a desired position of the surface of the sheet P. Thereafter, the head control portion 132 controls the head 11 to eject the ink onto the transparent image that has been formed on the surface of the sheet P after a lapse of the prescribed time from detection of the sheet P by the sensor 33. Thus, the image is formed on the sheet P on which the image-quality enhancement liquid has been ejected.

Thereafter, the image-formed sheet P is discharged to the discharge portion 31 by the feed roller pairs 55-57. Thus, the printing operation by the printer 1 is completed.

The sheet P can be conveyed and the image can be formed on the sheet Pin an instance where each of the sheets P accommodated in the sheet tray 20 and the manual feeding tray 22 has a certain size, i.e., a sheet size that enables the sheet P to be conveyed between the feed roller pairs 53, 54, a distance of the feed roller pairs 53, 54 along the conveyance direction being longer than any of distances between the other feed roller pairs. However, in some cases, a sheet P1 is erroneously accommodated in the sheet tray 20 or the manual feeding tray 22, which sheet P1 has a size in the conveyance direction smaller than the distance S2 and larger than the following distances, i.e., the distance between the first sheet supply portion 1*c* and the feed roller pair 51, the distance between the feed roller pair 51 and the feed roller pair 52, the distance between the feed roller pair 52 and the feed roller pair 53, and the distance between the second sheet supply portion 1*d* and the feed roller pair 53.

In such a case, the sheet P1 can be conveyed by the feed roller pairs 51-53 from the sheet tray 20 or the manual feeding tray 22 to a position upstream of the feed roller pair 54, and the image-quality enhancement liquid is ejected from the head 10 to the sheet P1. However, because the distance S1 between the feed roller pairs 53, 54 is larger than the size of the sheet P1 in the conveyance direction, the sheet P1 drops onto the guide 44. In other words, by providing, on the upstream side of the feed roller pair 54 disposed upstream of the head 11, a section of the sheet conveyance path defined by and between the feed roller pairs 53, 54 which are spaced apart from each other by the distance S1 larger than the distance S2, the sheet P1 having the size in the conveyance direction smaller than the distance S1 is not conveyed to the position at which the sheet P1 is to be opposed to the head 11. In other words, the sheet P1 is not conveyed between the feed roller pairs 54, 55. Accordingly, the image-quality enhancement liquid which has been applied to the sheet P1 by the bead 10 is not attached to the head 11.

In an instance where the sheet P1 drops onto the guide 44, the sensor 33 does not detect the sheet P1 within the prescribed time. Accordingly, the judge portion 133 controls the buzzer 8 to generate a sound, so that the user is notified of an error. When the first housing 1*a* is pivoted by the user so as to be placed at the open position after the error notification, the sheet P1 on the guide 44 can be removed. There may be a case in which it takes some time before the user removes the sheet P1 and accordingly the sheet P is curved due to the image-quality enhancement liquid applied thereto and the image-quality enhancement liquid is attached to the ejection surface 10*a*. In such a case, because the liquid ejected from the ejection openings of the ejection surface 10*a* is the same image-quality enhancement liquid, no reaction occurs even if the image-quality enhancement liquid is attached to the ejection surface 10*a*. Accordingly, there are not formed, in the ejection openings and the vicinity thereof, solid matters which would be otherwise formed by the reaction. Hence, there occurs no ejection failure of the image-quality enhancement liquid from the head 10.

Like the sheet P1 described above, a sheet having a size in the conveyance direction that is smaller than the distance S1 and larger than the distance S2 similarly drops onto the guide 44. Accordingly, the same advantages described above can be obtained. Where a sheet has a size in the conveyance direction that is smaller than at least one of the following distances, namely, the distance between the first sheet supply portion 1*c* and the feed roller pair 51, the distance between the feed roller pair 51 and the feed roller pair 52, the distance between the feed roller pair 52 and the feed roller pair 53, and the distance between the second sheet supply portion 1*d* and the feed roller pair 53, the sheet is not nipped by and between any of two components which are spaced apart from each other by a distance larger than the size of the sheet in the conveyance direction. In this instance, the sheet P is not conveyed or does not reach a position at which the sheet P is opposed to the head 10.

In the printer 1 according to the exemplary embodiment, even where the sheet whose size in the conveyance direction is smaller than the certain size described above is conveyed, the sheet is not conveyed to a position at which the sheet P is opposed to the head 11. Accordingly, it is possible to restrain the ejection failure of the head 11 which would be otherwise caused by attachment, to the head 11, of the image-quality enhancement liquid that has been ejected to the sheet by the head 10.

In the illustrated embodiment, the two roller pairs which are spaced apart from each other by the distance S1 larger than the distance S2 are constituted by: the feed roller pair 54 which defines the distance S2 together with the feed roller pair 55; and the feed roller pair 53 disposed upstream of the feed roller pair 54 so as to be adjacent thereto. Further, the feed roller pairs 53, 54 are disposed so as to sandwich the head 10 therebetween. Accordingly, it is not necessary to provide, upstream of the head 10 (or the feed roller pair 53), a section of the sheet conveyance path defined by and between the two feed roller pairs which are spaced apart by the distance S1. Hence, it is possible to make the sheet conveyance path relatively short, contributing to downsizing of the apparatus.

In the illustrated embodiment, the two feed roller pairs 53, 54 which are spaced apart from each other by the distance S1, namely, which provide the distance S1, are disposed downstream of the joint portion at which the portion of the sheet conveyance path through which the sheet P supplied from the first sheet supply portion 1*c* is conveyed and the portion of the sheet conveyance path through which the sheet P supplied from the second sheet supply portion 1*d* is conveyed are joined. Accordingly, there is no need to dispose the two roller pairs which provide the distance S1 for each of the two sheet supply portions 1*c*, 1*d*. Therefore, the sheet whose size in the conveyance direction is smaller than the certain size described above is not conveyed to the downstream side of the feed roller pair 54, irrespective of whether the sheet is supplied from the first sheet supply portion 1*c* or the second sheet supply portion 1*d*.

Figure 4:
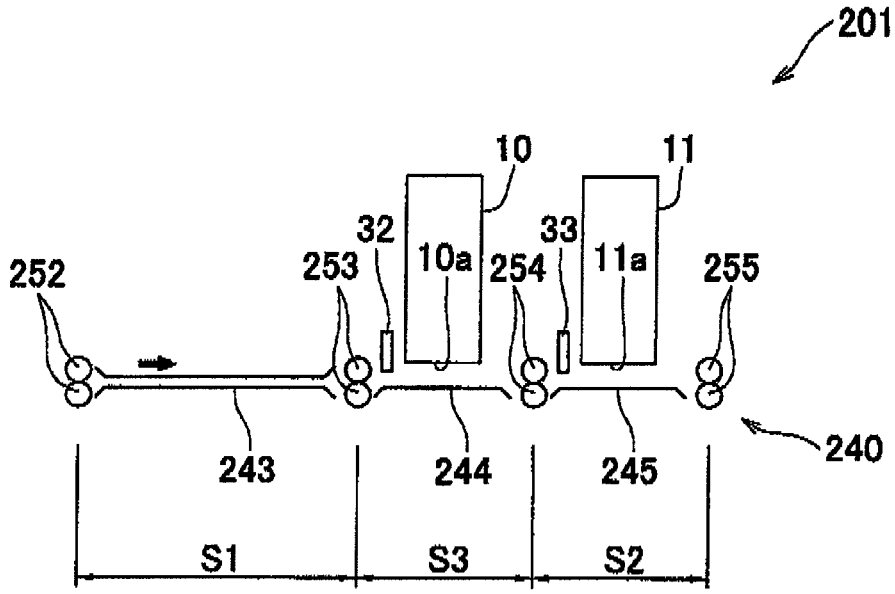
FIG. 4 is a partial side view showing a schematic structure of a printer according to a second embodiment of the invention.

Referring next to FIG. 4, there will be explained a printer 201 according to a second embodiment of the invention. As shown in FIG. 4, the printer 201 of the second embodiment has a conveyor mechanism 240 which partly differs in construction from the conveyor mechanism 40 of the illustrated first embodiment. More specifically, the conveyor mechanism 240 is substantially identical in construction with the conveyor mechanism 40, except that the conveyor mechanism 240 includes four feed roller pairs 252-255 and three guides 243-245, in place of the three feed roller pairs 53-55 and the two guides 44, 45 in the illustrated first embodiment. In the second embodiment, the same reference numerals as used in the first embodiment are used to identify the corresponding components and its explanation is dispensed with.

The feed roller pair 252 is configured to convey a sheet P supplied from the sheet supply portion in the conveyance direction (indicated by an arrow in FIG. 4). The feed roller pairs 253-255 are configured to convey the sheet P sent thereto in the conveyance direction. A feed roller pair 252 (as one of third conveying portions) is disposed so as to be spaced apart from the feed roller pair 253 in the conveyance direction, such that a distance S1 between the feed roller pair 252 and the feed roller pair 253 is larger than a distance S2 between the feed roller pair 254 (as a first conveying portion) and a feed roller pair 255 (as a second conveying portion). The feed roller pair 253 (as one of third conveying portions) is disposed so as to be spaced apart from the feed roller pair 254 in the conveyance direction, such that a distance S3 between the feed roller pair 253 and the feed roller pair 254 is not larger than the distance S2.

In the second embodiment, the two feed roller pairs 252, 253, which provide the distance S1 larger than the distance S2 between the two feed roller pairs 254, 255 disposed with the head 11 interposed therebetween, are disposed upstream of the head 10 so as to be adjacent to each other in the conveyance direction. Accordingly, where a sheet whose size in the conveyance direction is smaller than the distances S2, S3 is conveyed from the sheet supply portion, the sheet drops onto the guide 243. Therefore, the sheet whose size in the conveyance direction is smaller than a certain size, namely, smaller than the distance S1, is not conveyed to the positions at which the sheet is opposed to the respective heads 10, 11, namely, is not conveyed between the feed roller pairs 253, 254 and between the feed roller pairs 254, 255. Further, the feed roller pairs 252, 253 are disposed upstream of the most upstream head 10, so that the sheet whose size is smaller than the certain size is not conveyed to the position at which the sheet is opposed to the head 10. Accordingly, the image-quality enhancement liquid is not ejected to the sheet in question, making it possible to restrain wasteful consumption of the image-quality enhancement liquid.

Figure 5:
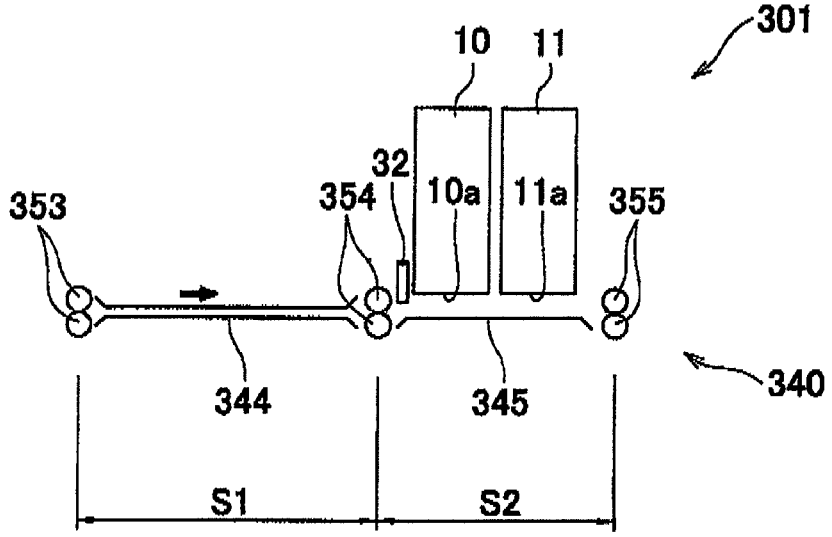
FIG. 5 is a partial side view showing a schematic structure of a printer according to a third embodiment of the invention.

Referring next to FIG. 5, there will be explained a printer 301 according to a third embodiment of the invention. As shown in FIG. 5, the printer 301 in the third embodiment has a conveyor mechanism 340 which partly differs in construction from the conveyor mechanism 40 of the illustrated first embodiment. More specifically, the conveyor mechanism 340 is substantially identical in construction with the conveyor mechanism 40, except that the conveyor mechanism 340 includes three feed roller pairs 353-355 and two guides 344, 345, in place of the three feed roller pairs 53-55 and the two guides 44, 45 of the first embodiment. In the printer 301, a distance between the two heads 10, 11 in the conveyance direction is made smaller than that in the illustrated first embodiment. Further, only the sensor 32 is disposed. In this instance, where the sensor 32 does not detect the sheet within a prescribed time after initiation of the conveyance of the sheet from the sheet supply portion, the judge portion 133 judges that the sheet conveyance failure is occurring, and the control similar to that described above is executed. In the third embodiment, the same reference numerals as used in the illustrated first embodiment are used to identify the corresponding components and its explanation is dispensed with.

The feed roller pair 353 is configured to convey a sheet P supplied from the sheet supply portion in the conveyance direction (indicated by an arrow in FIG. 5). The feed roller pairs 354, 355 are configured to convey the sheet P sent thereto in the conveyance direction. The feed roller pair 353 (as a third conveying portion) is disposed so as to be spaced apart from the feed roller pair 354 in the conveyance direction, such that a distance S1 between the feed roller pair 353 and the feed roller pair 354 (as a first conveying portion) is larger than a distance S2 between the feed roller pair 354 and the feed roller pair 355 (as a second conveying portion).

In the third embodiment, the two feed roller pairs 353, 354, which provide the distance S1 larger than the distance S2 between the two feed roller pairs 354, 355 disposed with the head 11 interposed therebetween, are disposed upstream of the head 10 so as to be adjacent to each other in the conveyance direction. Accordingly; where a sheet whose size in the conveyance direction is smaller than the distance S2 is conveyed from the sheet supply portion, the sheet drops onto the guide 344. Therefore, the sheet whose size in the conveyance direction is smaller than a certain size, namely, smaller than the distance S1, is not conveyed to the positions at which the sheet is opposed to the respective heads 10, 11, namely; is not conveyed between the feed roller pairs 354, 355. Further, the two feed roller pairs 353, 354 are disposed upstream of the most upstream head 10, so that the sheet whose size is smaller than the certain size is not conveyed to the positions at which the sheet is opposed to the respective heads 10, 11. Accordingly, the image-quality enhancement liquid and the ink are not ejected to the sheet in question, making it possible to restrain wasteful consumption of the image-quality enhancement liquid and the ink.

In the illustrated first through third embodiments, the most upstream head 10 ejects the image-quality enhancement liquid, and the head 11 disposed downstream of the head 10 ejects the ink. The head 10 may be configured to eject the ink while the head 11 may be configured to eject the image-quality enhancement liquid. In other words, the first liquid may be the ink while the second liquid may be the image-quality enhancement liquid. In this case, there can be obtained advantages similar to those described above.

Figure 6:
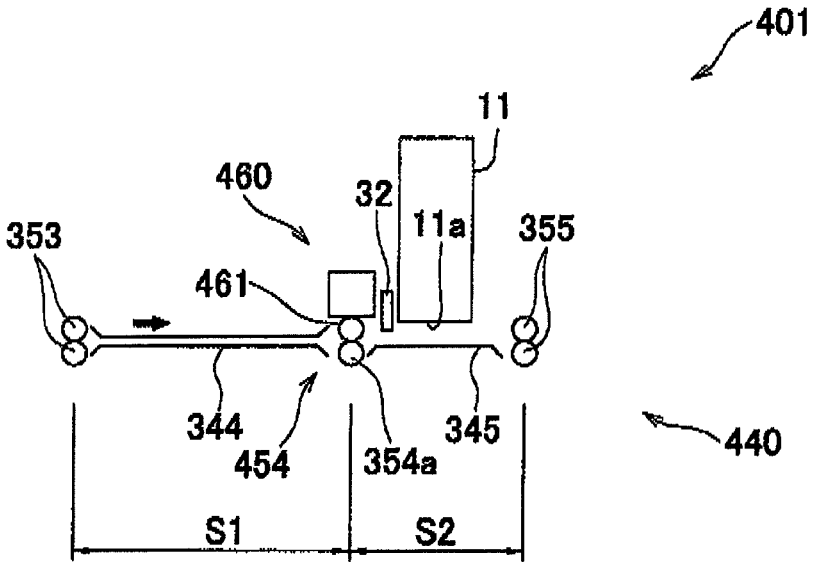
FIG. 6 is a partial side view showing a schematic structure of a printer according to a fourth embodiment of the invention.
Figure 7:
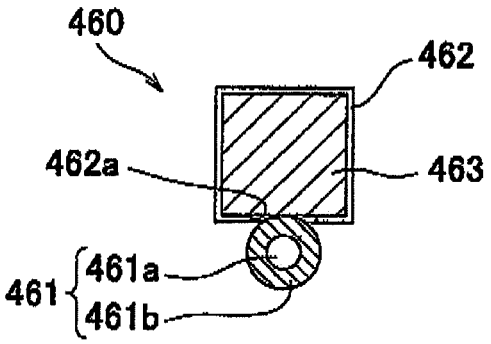
FIG. 7 is a cross-sectional view of a coating mechanism shown in FIG. 6.

Referring next to FIGS. 6 and 7, there will be explained a printer 401 according to a fourth embodiment of the invention. As shown in FIG. 6, the printer 401 has a conveyor mechanism 440 which partly differs in construction from the conveyor mechanism 340 of the illustrated third embodiment. More specifically, the conveyor mechanism 440 is substantially identical in construction with the conveyor mechanism 340, except that the conveyor mechanism 440 has a coating mechanism 460 (as a first applicator) configured to coat the surface of a sheet P with the image-quality enhancement liquid, in place of the upper roller of the feed roller pair 354 of the illustrated third embodiment. Since the printer 401 has the coating mechanism 460 to coat the surface of the sheet P with the image-quality enhancement liquid, only the head 11 to eject the ink is provided. In the fourth embodiment, the same reference numerals as used in the third embodiment are used to identify the corresponding components and its explanation is dispensed with.

As shown in FIGS. 6 and 7, the coating mechanism 460 includes a coating roller 461, a casing 462, and an absorber 463 accommodated in the casing 462. The coating roller 461 is disposed so as to be opposed to the lower roller 354*a* of the feed roller pair 354 of the third embodiment, such that the sheet P can be nipped therebetween. The roller 354*a* and the coating roller 461 constitute a feed roller pair 454 (as a first conveying portion). The coating roller 461 has a shaft 461*a* and a covering portion 461*b* that covers an outer circumference of the shaft 461*a*. The covering portion 461*b* is formed of a porous material such as a sponge. The coating roller 461 is disposed such that the covering portion 461*b* thereof is in contact with the absorber 463 through an opening 462*a* formed in the casing 462.

The absorber 463 is also formed of a porous material such as a sponge. There is provided, on an upper surface of the casing 462, a joint (not shown) to which is attached a tube connected to a cartridge (not shown) storing the image-quality enhancement liquid. When the image-quality enhancement liquid held by the absorber 463 is absorbed by the covering portion 461*b* and the image-quality enhancement liquid held by the absorber 463 is reduced, the absorber 468 automatically absorbs the image-quality enhancement liquid stored in the cartridge.

In this structure, the coating mechanism 460 applies the image-quality enhancement liquid to the entirety of the surface of the sheet P which is conveyed in the conveyance direction while being nipped by and between the coating roller 461 and the roller 354*a*.

In the fourth embodiment, the two feed roller pairs 353, 454, which provide the distance S1 larger than the distance S2 between the two feed roller pairs 454, 355 disposed with the head 11 interposed therebetween, are disposed upstream of the head 11 so as to be adjacent to each other in the conveyance direction. Accordingly, where a sheet whose size in the conveyance direction is smaller than the distance S2 is conveyed from the sheet supply portion, the sheet drops onto the guide 344. Therefore, the sheet whose size in the conveyance direction is smaller than a certain size, namely, smaller than the distance S1, is not conveyed to the position at which the sheet is opposed to the head 11, namely; is not conveyed between the feed roller pairs 454, 355. Further, a section of the sheet conveyance path having the distance S1 is provided upstream of the feed roller pair 454, so that the sheet whose size is smaller than the certain size is not conveyed to the position of the feed roller pair 454. Accordingly, the image-quality enhancement liquid is not applied by the coating roller 461 to the sheet, making it possible to restrain wasteful consumption of the image-quality enhancement liquid.

As a modification, the feed roller pair 454 may be replaced with the feed roller pair 358, and the feed roller pair 353 may be replaced with the feed roller pair 454. In this case, too, the sheet whose size is smaller than the certain size is not conveyed to the position at which the sheet is opposed to the head 11, namely, is not conveyed between the feed roller pairs 353, 355.

While the preferred embodiments of the invention have been described, the invention is not limited to the details of the illustrated embodiments, but may be otherwise embodied with various changes and modifications, which may occur to those skilled in the art, without departing from the scope of the invention defined in the appended claims. While the conveyor mechanism 40, 240, 340, 440 in each of the illustrated embodiments has the feed roller pairs each as the conveying portion, the conveying portion may be constituted by components other than the roller pairs, such as a conveyor belt.

The present invention is applicable not only to the monochrome printer, but also to a color printer. Further, the present invention is applicable to both of a printer of a line type and a printer of a serial type. The present invention is applicable not only to the printer, but also to a facsimile machine, a copying machine, and the like. Each head may be configured to eject a liquid other than the image-quality enhancement liquid and the ink. In this instance, one of the liquids needs to coagulate or precipitate a component of the other of the liquids by acting thereon. The number of the heads of the image forming apparatus may be at least two. The recording medium is not limited to the sheet P, but any other recordable medium may be employed. Either one of the first sheet supply portion 1*c* and the second sheet supply portion 1*d* may be provided. Three or more sheet supply portions may be provided. As in the illustrated embodiments, in this instance, a portion of the sheet conveyance path having the distance S1 may be provided downstream of a joint portion at which portions of the sheet conveyance path through which the sheets supplied from the respective sheet supply portions pass are joined.

The invention claimed is:

1. An image forming apparatus, comprising:

a conveyor configured to convey a recording medium through a conveyance path in a conveyance direction;

a first applicator configured to apply a first liquid to the recording medium that is conveyed by the conveyor; and a second applicator disposed downstream of the first applicator in the conveyance direction and configured to apply a second liquid to the recording medium that is conveyed by the conveyor, wherein the first liquid acts on the second liquid, causing one of coagulation and precipitation of a component of the second liquid, wherein the first applicator is configured to eject the first liquid on the recording medium such that a landing position of the first liquid is a same position on which the second liquid ejected from the second applicator lands, wherein the conveyor comprises: a first pair of rollers, a second pair of rollers, and at least one third pair of rollers each having an upper roller and a lower roller between which the recording medium is held, the second pair of rollers being disposed adjacent to and downstream of the first pair of rollers in the conveyance direction, and the at least one third pair of rollers being disposed upstream of the first pair of rollers in the conveyance direction, wherein the second applicator is disposed between the first pair of rollers and the second pair of rollers, and wherein the first pair of rollers and the at least one third pair of rollers constitute a plurality of upstream-side pairs of rollers disposed upstream of the second pair of rollers in the conveyance direction, wherein a distance by which respective adjacent two upper rollers of adjacent two of the plurality of upstream-side pairs of rollers are spaced apart from each other in the conveyance direction is larger than a distance by which the upper roller of the first pair of rollers and the upper roller of the second pair of rollers are spaced apart from each other in the conveyance direction, and a distance by which respective adjacent two lower rollers of the adjacent two of the plurality of upstream-side pairs of rollers are spaced apart from each other in the conveyance direction is larger than a distance by which the lower roller of the first pair of rollers and the lower roller of the second pair of rollers are spaced apart from each other in the conveyance direction, wherein the image forming apparatus comprises a first guide member and a second guide member each configured to guide the recording medium, the first guide member being disposed between first pair of rollers and the second pair of rollers, and the second guide member being disposed between the adjacent two of the plurality of upstream-side pairs of rollers, wherein a length of the second guide member in the conveyance direction is larger than that of the first guide member in the conveyance direction.

2. The image forming apparatus according to claim 1, wherein the at least one third pair of rollers comprises a third pair of rollers that is disposed adjacent to the first pair of rollers in the conveyance direction, and a distance by which the upper roller of the first pair of rollers and the upper roller of the third pair of rollers are spaced apart from each other in the conveyance direction is larger than the distance by which the upper roller of the first pair of rollers and the upper roller of the second pair of rollers are spaced apart from each other in the conveyance direction, and a distance by which the lower roller of the first pair of rollers and the lower roller of the third pair of rollers are spaced apart from each other in the conveyance direction is larger than the distance by which the lower roller of the first pair of rollers and the lower roller of the second pair of rollers are spaced apart from each other in the conveyance direction.

3. The image forming apparatus according to claim 1, wherein the at least one third pair of rollers comprises two third pairs of rollers that are adjacent to each other in the conveyance direction, and a distance by which respective upper rollers of the two third pairs of rollers are spaced apart from each other in the conveyance direction is larger than the distance by which the upper roller of the first pair of rollers and the upper roller of the second pair of rollers are spaced apart from each other in the conveyance direction, and a distance by which respective lower rollers of the two third pairs of rollers are spaced apart from each other in the conveyance direction is larger than the distance by which the lower roller of the first pair of rollers and the lower roller of the second pair of rollers are spaced apart from each other in the conveyance direction.

4. The image forming apparatus according to claim 1, wherein the first applicator is disposed between the first pair of rollers and one of the at least one third pair of rollers that is disposed adjacent to the first pair of rollers.

5. The image forming apparatus according to claim 1, wherein the upper roller of the first pair of rollers, which comes into contact with one surface of the recording medium that is to be opposed to the second applicator, functions as the first applicator.

6. The image forming apparatus according to claim 1, further comprising two sheet suppliers each configured to supply the recording medium to the conveyor, wherein the adjacent two of the plurality of upstream-side pairs of rollers, which are spaced apart from each other in the conveyance direction by the distance that is larger than the distance by which the first pair of rollers and the second pair of rollers are spaced apart from each other in the conveyance direction, are located downstream of a joint portion at which a portion of the conveyance path through which the recording medium supplied by one of the two sheet suppliers is conveyed and a portion of the conveyance path through which the recording medium supplied by the other of the two sheet suppliers is conveyed are joined.

7. The image forming apparatus according to claim 1, wherein the distance by which the lower roller of the first pair of rollers and the lower roller of one of the at least one third pair of rollers, that is adjacent to the first pair of rollers, are spaced apart from each other in the conveyance direction is larger than the distance by which the lower roller of the first pair of rollers and the lower roller of the second pair of rollers are spaced apart from each other in the conveyance direction by more than 5 percent of the distance between the lower roller of the first pair of rollers and the lower roller of the second pair of rollers.

8. The image forming apparatus according to claim 1, wherein the distance by which the upper roller of the first pair of rollers and the upper roller of one of the at least one third pair of rollers, that is adjacent to the first pair of rollers, are spaced apart from each other in the conveyance direction is larger than the distance by which the upper roller of the first pair of rollers and the upper roller of the second pair of rollers are spaced apart from each other in the conveyance direction by more than 5 percent of the distance between the upper roller of the first pair of rollers and the upper roller of the second pair of rollers.

9. The image forming apparatus according to claim 1, wherein the conveyor comprises a plurality of pairs of rollers each disposed at the conveyance path, the plurality of pairs of rollers including at least the first pair of rollers, the second pair of rollers and the at least one third pair of rollers, wherein the distance between the first pair of rollers and one of the at least one third pair of rollers, that is adjacent to the first pair of rollers, in the conveyance direction is the largest distance of distances between two adjacent pairs of rollers of the plurality of pairs of rollers in the conveyance direction.

10. The image forming apparatus according to claim 1, wherein the upper roller and the lower roller of the first pair of rollers are disposed at the same position in the conveyance direction, the upper roller and the lower roller of the second pair of rollers are disposed at the same position in the conveyance direction, and the upper roller and the lower roller of one of the at least one third pair of rollers, that is adjacent to the first pair of rollers in the conveyance direction, are disposed at the same position in the conveyance direction.

11. The image forming apparatus according to claim 1, further comprising:

a first housing configured to support the first applicator and the second applicator;

a second housing configured to support the first guide member and the second guide member, wherein the first housing is pivotable, with respect to the second housing, about a hinge portion and is placed between a closed position and an open position at which the first housing is spaced apart from the second housing compared to the closed position, wherein the first applicator is disposed between the first pair of rollers and the at least one third pair of rollers, and wherein the at least one third pair of rollers, the first pair of rollers, and the second pair of rollers are arranged in order of decreasing a distance to the hinge portion in a horizontal direction.

* * * * *